US006209590B1

(12) United States Patent
Mandsberg

(10) Patent No.: US 6,209,590 B1
(45) Date of Patent: Apr. 3, 2001

(54) METHOD AND A SYSTEM FOR FILLING ICE CREAM INTO CUP-SHAPED CONTAINERS

(75) Inventor: Søren Mandsberg, Kolding (DK)

(73) Assignee: Tetra Pak Hoyer A/S, Højbjerg (DK)

( * ) Notice: Subject to any disclaimer, the term of this patent is extended or adjusted under 35 U.S.C. 154(b) by 0 days.

(21) Appl. No.: 09/419,942

(22) Filed: Oct. 18, 1999

(30) Foreign Application Priority Data

Oct. 16, 1998 (DK) ..... 1998 01329

(51) Int. Cl.[7] ..... B65B 1/04

(52) U.S. Cl. ..... 141/1; 141/129; 141/82; 141/260

(58) Field of Search ..... 141/129, 131, 141/156, 157, 160, 178, 179, 82, 83, 250, 251, 252, 260

(56) References Cited

U.S. PATENT DOCUMENTS 4,942,910 * 7/1990 Hamamura ..... 141/9

5,309,955 * 5/1994 Torterotot ..... 141/1

* cited by examiner

*Primary Examiner*—Steven O. Douglas
(74) *Attorney, Agent, or Firm*—Nixon Peabody LLP; David S. Safran

(57) ABSTRACT

In connection with the production and the portioning-out of ice cream to packaging cups, changes can arise in the character and specific gravity of the ice cream. This occurs particularly during the start-up phase, whereby it is customary that a large number of the cups with incorrect filling have to be discarded. To ensured that all the cups are totally filled, use is made of a controllable step- or servomotor for the raising and lowering of the cups in relation to a continuously-operating filling nozzle, and the cups are then conveyed through a weighing station for a control weighing of the total filling. The weighing signals are fed back to the processing plant for the regulation of the specific gravity and character of the ice cream. In most cases, the "incorrect" cups will still be marketable, in that they will at least be correctly filled with a product which, despite all other things, will be acceptable.

8 Claims, 1 Drawing Sheet

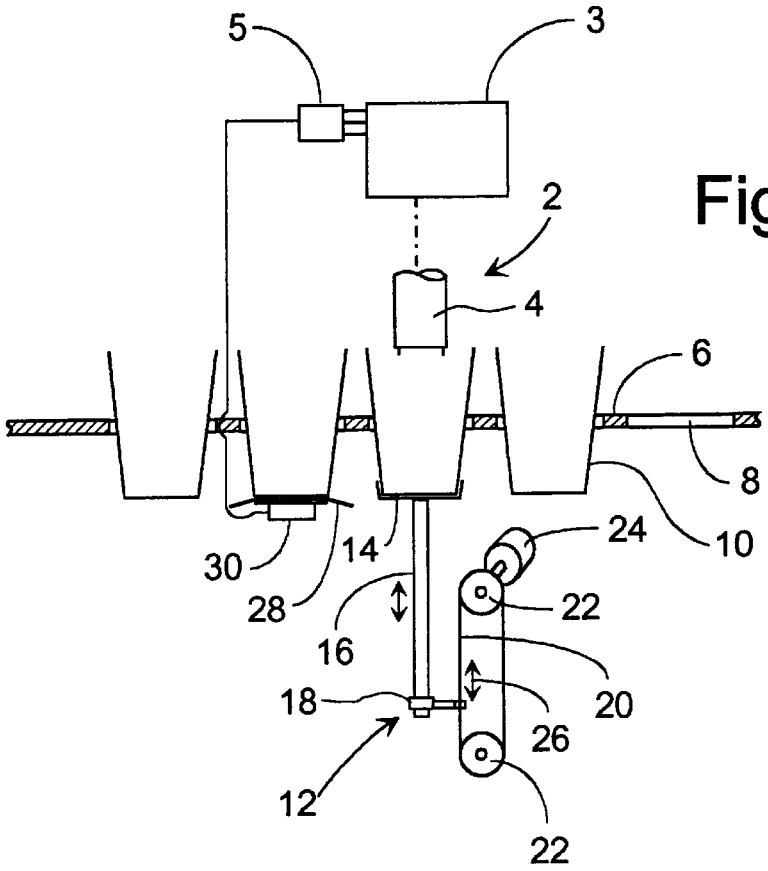
Fig.1
Fig.2
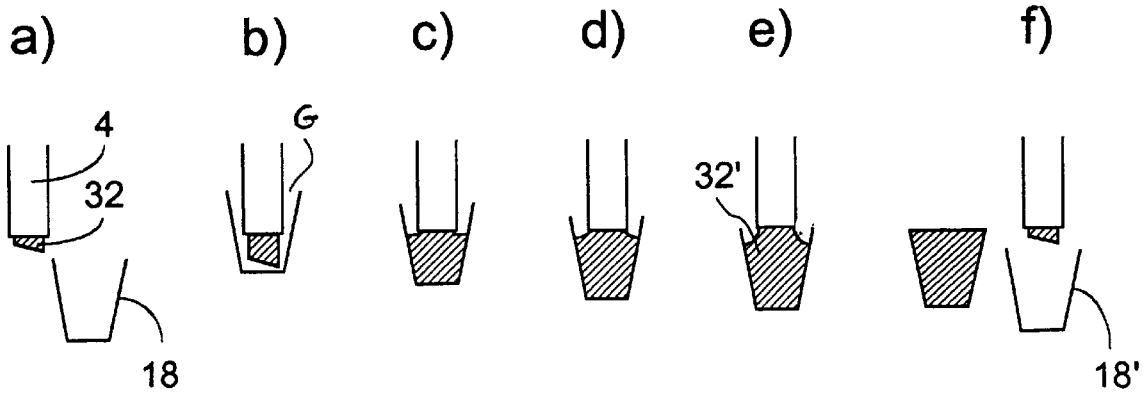

METHOD AND A SYSTEM FOR FILLING ICE CREAM INTO CUP-SHAPED CONTAINERS

BACKGROUND OF THE INVENTION

Field of the Invention

The present invention concerns a method and an arrangement for the filling of cup-shaped packaging containers with viscous substances such as ice cream from a preferably continuously-operating filling nozzle disposed over a transported series of said cups, in that upon arrival at the nozzle the cups are successively raised quickly up to a position around the filling nozzle, and thereafter lowered in a slower movement corresponding to the increasing degree to which the cup is filled until the upper edge has been lowered to the level of the lower end of the nozzle, after which the cup is displaced horizontally, whereby it is achieved that the upper edge of the cup serves to cut off the string of the mass from the nozzle. In immediate connection herewith, the next cup is fed to the nozzle so that the filling of the next cup can begin without the flow from the nozzle having to be stopped.

This hereby involves relatively simple movements, i.e. a horizontal movement of the series of cups and a vertical movement of the cup in the filling position. It has proved, however, that the relevant vertical movement, which is typically controlled by means of a compressed air cylinder, is nevertheless difficult to control in an optimum manner for achieving a desirably precise top filling of the cups, i.e. without short filling of the cups and without surplus discharge of the filling mass from the nozzle. It is not least at the beginning of each daily production that ice cream masses with different viscosity and specific gravity can appear from the nozzle, and there can be quite long running-in periods during which the filling of the cups is so incorrect that many of these cups have to be discarded almost as unmarketable waste.

SUMMARY OF THE INVENTION

With the present invention, focus is placed on two different process aspects for solving or reducing these problems, i.e. partly by a continuous control weighing of the just filled cups, with the associated possibility for immediate feed-back control of the relevant process steps, and partly by use of a differentiated, controllable regulation of the vertical movements of the cups in relation to the filling nozzle, to which can also be added a control of the horizontal movement of the cups.

With the invention, a main consideration is thus that quite great advantages will be able to be gained by a regulation of the cup movement means in order to achieve that the cups are completely filled, and thereafter to carry out the process adjustments which are necessary for regulating the filling weight to a desired amount.

Here, the use of other means of movement for controlled vertical movement of the cups shall not be renounced, but with the invention it has been found that the ordinary air cylinders are not suitable for control as desired, while by making use of a servo-motor the sequence can be controlled in precisely the desired manner, i.e. with regard not only to speed and position but also power output. In principle, a servo-motor can control a reciprocating movement via a threaded spindle, but with the invention it has been found more expedient to let the motor pull on a vertically-disposed belt loop, which at its one side is in support connection with a supporting element for the cups in the filling station. A change between low and high speed can hereby be carried easily and with minimal influence of wear.

During the filling operation the cup and its supporting element will be affected not only by the weight of the already received filling mass, but also—and to a much higher degree—by the pressure exerted by the jet of the mass leaving the filling nozzle. The associated lowering of the cup, therefore, is not a matter of active lowering, but rather a matter of a controlled braking, and the said servo-motor is a perfect means for such a braking, inasfar as it can be ajusted to yield a suitable counter torque.

For a more detailed description of the desirable aspects of the invention, reference is made here to the drawing.

BRIEF DESCRIPTION OF THE DRAWINGS

FIG. 1 is a schematic side view of a filling station according to the invention, and FIG. 2*a*)–*f*) is a sequential series of views for the illustration of the filling sequence.

DETAILED DESCRIPTION OF THE INVENTION

In FIG. 1 it is shown that a filling station 2 with an overlying filling nozzle 4 is fed by conveyer 6 with holes 8 in which there are empty cups 10. The conveyer 6 can be a belt or a turn-table which is incremented in steps to bring the cups 10 to a position under the nozzle 4. However, it will also lie within the scope of the invention for the conveyor to be moved continuously, while the nozzle 4 and an underlying height control system 12 for the cups is fed forwards and backwards in order to effect the desired filling of the cups.

The said height control system 12 consists of an upper bottom support plate 14 for the cups 10, and from here a downwards-extending support rod 16 which, via a coupling part 18, is firmly connected to the one vertical section of a belt loop 20 which extends between an upper and a lower reversing wheel 22, one of which is driven by a servomotor 24 for the controlling up and down of the coupling part 18 along the shown arrow 26. The cups 10 are fed to the filling station at a height at which their upper edges are lying on a level slightly below the mouth of the filling nozzle 4.

In a position immediately after the filling nozzle 4, the now filled cups are brought to rest on a weighing platform 28, whereby the filling weight can be registered via a weighing unit 30.

It is schematically shown that the filling mass is supplied to the nozzle 4 from a processing plant 3, in which the mass if prepared with various parameter settings controllable from a control unit 5, the weighing unit 30 is connected to this control unit.

As shown in FIG. 2*a*), an initial step will be that an empty cup 10 is fed in to a position under the nozzle 4, with the upper edge of the cup lying so far down under the nozzle mouth that the edge of the cup will not interfere with a string 32 of filling material extending down from the nozzle. Immediately thereafter, the servomotor 24 is activated for the raising of the cup to the position shown in FIG. 2*b*), where the cup begins to receive the ice cream mass which is supplied to the bottom of the cup.

As already mentioned, the filling mass will hit the cup as a powered jet and will thus force the cup downwards. However, at this stage the servomotor is actuated to provide a torque that will effectively balance the jet pressure. It must be mentioned that in addition to this dynamic impact there will be a downwardly directed reaction force originating from the forcing up of the filling mass in the annular gap G between the outside of the filling jet and the inner wall of the cup, and also this force should be balanced out by the applied motor torque. It has been found that the width of this gap should preferably be 3–13 mm.

The motor 24 is then activated for the lowering of the cup at a speed which is controlled in such a manner that the cup is lowered at the same "volume speed" as the ice cream mass is introduced, i.e. during the lowering the cup will thus be held filled more or less to the level of the lower edge of the nozzle 4, FIG. 2*c*). When use is made of preferred cups which are conical in shape, this means that the lowering speed must be controlled in a suitably decreasing manner.

Towards the end of the lowering movement as shown in FIG. 2*d*), i.e. at a detected "almost lowermost" position of the cup, a lowering at increased speed is effected, i.e. by a related increase of the moment of force with which the servomotor influences the lowering arrangement, so that as shown in FIG. 2*e*), there will now occur a certain drawing-down of an ice cream string part 32' which is standing up to slightly above the general filling level in the cup and even to slightly above the upper-edge level of the cup.

As shown in FIG. 2*f*), when a cutting-over of the ice cream string 32' is hereafter effected by horizontal displacement of the cup 18, the drawn-up string 32' will distribute itself for top filling of the cup in connection with its sideways movement from the nozzle 4, and immediately afterwards cf. FIG. 2*f*) a new cup 18' will be introduced under the nozzle 4 for the execution of the filling operation.

By an appropriate monitoring, a control of the filling can thus be established very easily by the moving means for the cups being controlled for total filling of the cups immediately from the start. If or when it is ascertained by the immediately subsequent control weighing in the weighing station 30 that the totally filled and herewith marketable cups do not completely satisfy exact desired criteria regarding precise product weight, in the subsequent production it can, however, based on said monitoring, be quickly brought about that signals can be sent to the production equipment such that this normalises the situation, in that there shall thus merely be carried out a subsequent adjustment of the speed profile with which the motor 24 influences the cups 8 in order to ensure that these are still precisely filled, i.e. with neither over- nor under-filling.

The invention can be used in connection with both small and large cups, ranging e.g. from cups with a height of 80 mm and a diameter of 40 mm to one liter cups and even rectangular containers of five liters or more. Up to a volume of approximately one liter it has been found possible to operate with a capacity of some 80 filling cycles per minute.

What is claimed is:

1. Method for the filling of cup-shaped packaging containers with a viscous filling substance from a filling nozzle located above a conveyed series of cups, comprising the steps of:

successively, upon arrival at the filling nozzle, quickly raising the cups up to a position around the filling nozzle, and thereafter, lowering the cups in a slower movement which corresponds to building up of the viscous filling substance in the cups until an upper edge of the cups is lowered to below a lower end of the filling nozzle;

successively, horizontally displacing the cups from under the nozzle while using an upper edge of the cups to cut of a string of the viscous filling substance from the nozzle which can continue without stopping for filling of the next horizontally conveyed cup;

wherein vertical movement of the cups is performed by a motor in a manner such that the cups are completely filled with the viscous filling substance regardless of the physical properties of the substance; and wherein the filled cups are weighed and the weight used for controlling process parameters related thereto as filling of the cups continues.

2. A method according to claim 1, wherein the cups are conical and the controlled lowering of the cups is adjusted in accordance with increasing diameter of the cups as they are filled; wherein the speed at which each cup is lowered is increased just prior to final filling thereof so as to create a string of the viscous filling substance between the cup and nozzle which sinks down to provide a top filling of the cup when the cup is led sideways away from the nozzle.

3. A method according to claim 1, wherein the viscous filling substance is an at least semi-frozen food product and is fed continuously from said nozzle.

4. A method according to claim 1, wherein the filling substance is injected down into the cups with a substantial jet pressure and wherein the servomotor is energized so as to provide a torque counter balancing both the impact of the injected substance, and the reaction force from the rising substance in the cup.

5. Plant for the filling of cup-shaped packaging containers with a viscous substance comprising a process plant for the preparation of the viscous filling substance and a portioning-out unit with a filling nozzle which co-operates with a packaging cup conveyor system for successive conveying of cups to the nozzle, and means for producing a controlled raising and lowering of the cups relative to the nozzle to produce a controlled filling of the cups; wherein the means for producing a controlled raising and lowering of the cups comprises a motor and a control system for producing total filling of the cups, said conveyor system including a weighing station for weighing of filled cups and means for sending a weighing signal to the process plant for controlling process parameters for the further preparation of the viscous filling substance.

6. Plant according to claim 5, characterized in that depending on a lowered position reached by the cup, the movement system for the filling movement of the cups is arranged to briefly accelerate the lowering of the cup for subsequent sideways movement away from the nozzle, and at the same time for controlling the movement of the next empty cup to its filling position at the nozzle.

7. Plant according to claim 5, in which the servomotor is operable to provide a torque counter balancing both the impact of the filling substance against the cup being filled and the reaction force of the substance rising in the cup.

8. Plant according to claim 5, characterized in that during the main part of the lowering, the movement system for the lowering of the cups is arranged to control the lowering of conical cups at a slightly decreasing speed.

* * * * *